US006776628B2

(12) United States Patent
Foriska et al.

(10) Patent No.: US 6,776,628 B2
(45) Date of Patent: Aug. 17, 2004

(54) GROUND LEAD WITH INTEGRATED BUSHING APPARATUS AND METHOD

(75) Inventors: Matthew Frank Foriska, Harrisburg, PA (US); Galen M. Martin, Camp Hill, PA (US); Vincent M. Kane, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 8 days.

(21) Appl. No.: 10/316,487

(22) Filed: Dec. 11, 2002

(65) Prior Publication Data

US 2004/0115972 A1 Jun. 17, 2004

(51) Int. Cl.[7] ..... H01R 4/66; H01R 13/648

(52) U.S. Cl. ..... 439/92

(58) Field of Search ..... 439/92, 95–97, 439/101

(56) References Cited

U.S. PATENT DOCUMENTS 5,749,740 A * 5/1998 Swift et al. ..... 439/92
6,267,607 B1 * 7/2001 Fitch et al. ..... 439/92

* cited by examiner

*Primary Examiner*—Javaid H. Nasri

(57) ABSTRACT

A grounding device comprising a ground lead and a support bushing wherein the ground lead and the support bushing comprise a unitary structure.

8 Claims, 8 Drawing Sheets

GROUND LEAD WITH INTEGRATED BUSHING APPARATUS AND METHOD

FIELD OF THE INVENTION

This invention relates generally to grounding and more particularly to ground leads and support bushings, which create a grounding condition for an electrical apparatus.

BACKGROUND OF THE INVENTION

Grounding is the intentional electrical connection to a reference-conducting plane, which generally consists of a specific array of interconnected electrical conductors referred to as the grounding conductor. Grounding provides a zero point for an electrical conductor system.

Typically, grounding from a printed circuit board ("PCB") to a grounding feature utilizes two separate components. These two separate components provide a grounding path from a PCB, or another electrical device, to a grounding feature. The ground lead and support bushing are individually manufactured and processed, and subsequently bolted or screwed together when inserted onto the grounding feature. The support bushing provides structural support for a housing, which contains the ground lead contacted to the PCB. The resulting combination of the support bushing and grounding lead contacted to the PCB is subsequently bolted to a grounding feature. In one example, automobiles serve as a grounding feature for a PCB that is contained within a housing. To create a grounding path between the vehicle and the housed PCB, a ground lead is press fit or soldered to the housed PCB. The other end of the ground lead has a ring which fits over the top of the support bushing, which is contained in a mounting pad of the housing. To connect the housing containing the PCB, a bolt goes through the mounting pad, and then passes through the ring of the ground lead and through the support bushing and into the vehicle. As a result, the ground lead and support bushing provides an electrical connection from the PCB to the grounding feature. An electrical current passes from the PCB into the ground lead, which is soldered or press fit to the PCB. Then the electrical current passes to the support bushing, which is contacted to the grounding feature.

In order for grounding to be complete, the bushing and ground lead must be in contact to create a completed grounding path. If there is no contact between the support bushing and the ground lead, the grounding path from a PCB, or another electrical device to a grounding feature will be broken. If there is a gap between the support bushing and the ground lead, a non-grounding condition will be created. In view of the foregoing, there is a need to have a permanent and reliable contact between a support bushing and a ground lead.

SUMMARY OF THE INVENTION

The present invention provides apparatus and methods for constructing a support bushing and ground lead. In one embodiment, a ground lead and support bushing are constructed for insert molding by blanking and forming it from one piece of material to form a single integral and gaplessly continuous piece.

In another embodiment, the one-piece ground lead-support bushing provides a grounding path from a PCB, or another electrical device, to a grounding feature. One exemplary application for the one-piece ground lead-support bushing is in an automobile, where the ground lead-support bushing is assembled to the vehicle.

Another aspect of an embodiment of the invention is that the one-piece ground lead-support bushings are manufactured and processed from the same sheet of material.

In another embodiment, a carrier strip of material is blanked to provide a flat pattern of the one-piece ground lead-support bushing. Then the flat pattern is sent through a series of forming processes, which give the one-piece support bushing-grounding lead a shape that can be used in a variety of grounding applications.

DETAILED DESCRIPTION

Figure 1:
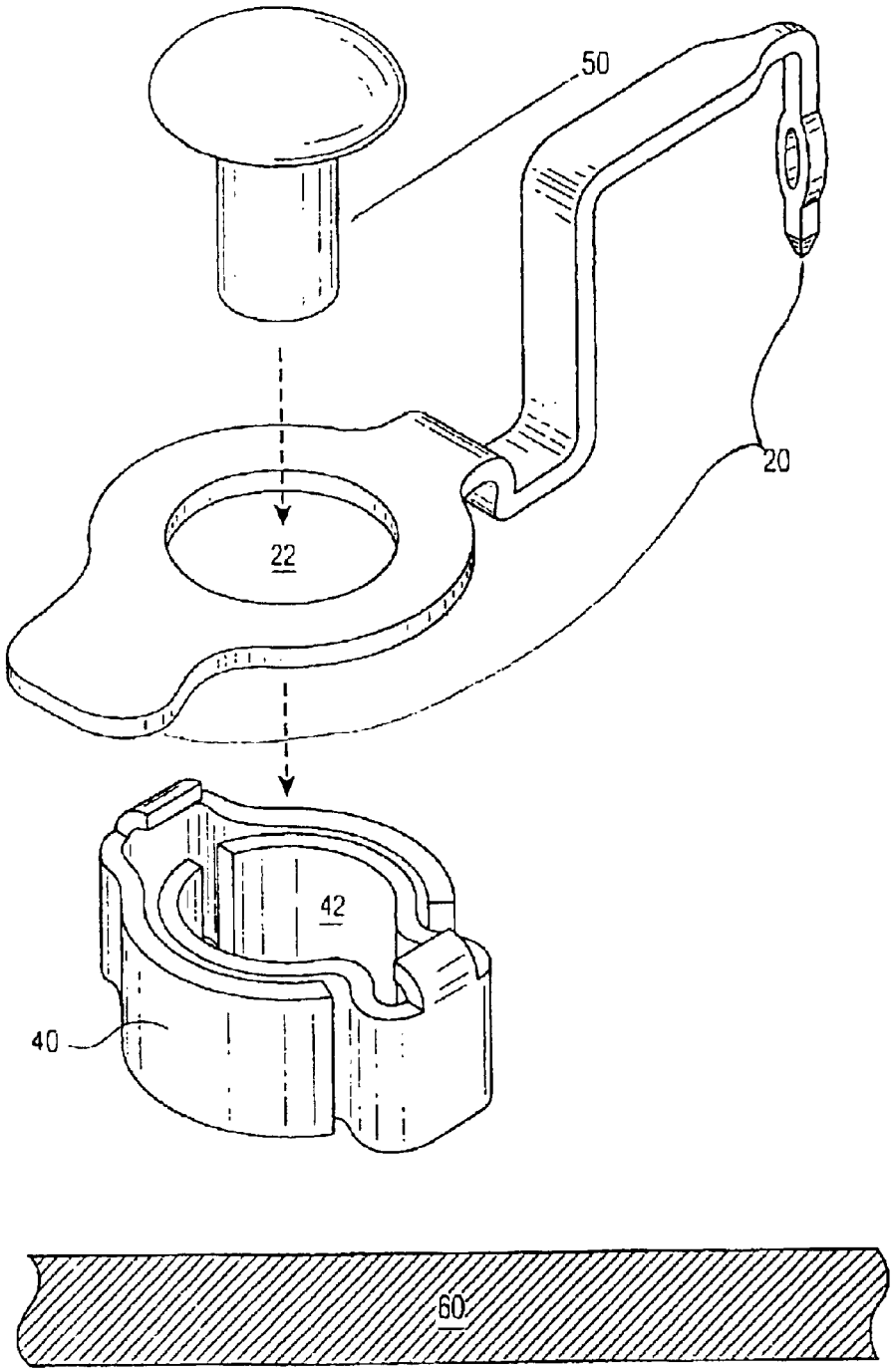
FIG. 1 is a perspective view of an exemplary unassembled ground lead and support bushing that is mounted to a grounding feature.

While the present invention is susceptible of embodiments in varied forms, what is shown in the drawings will hereinafter be understood to be an embodiment of the present invention. The present disclosure is to be considered as setting forth an exemplification of the invention, which in no way is intended to limit the invention to the specific embodiment illustrated below. In referring to the drawings, like reference numerals indicate like parts throughout the several drawings.

FIG. 1 shows an embodiment of a ground lead 20, support bushing 40, bolt 50 and grounding feature 60. The ground lead 20 and support bushing 40 are secured together by any suitable means, such as by a bolt 50. In this embodiment, bolt 50 is placed through the ground lead aperture 22, through the support bushing aperture 42, and then clamps the ground lead 20 to the support bushing 40 by attaching to the grounding feature 60.

Figure 2:
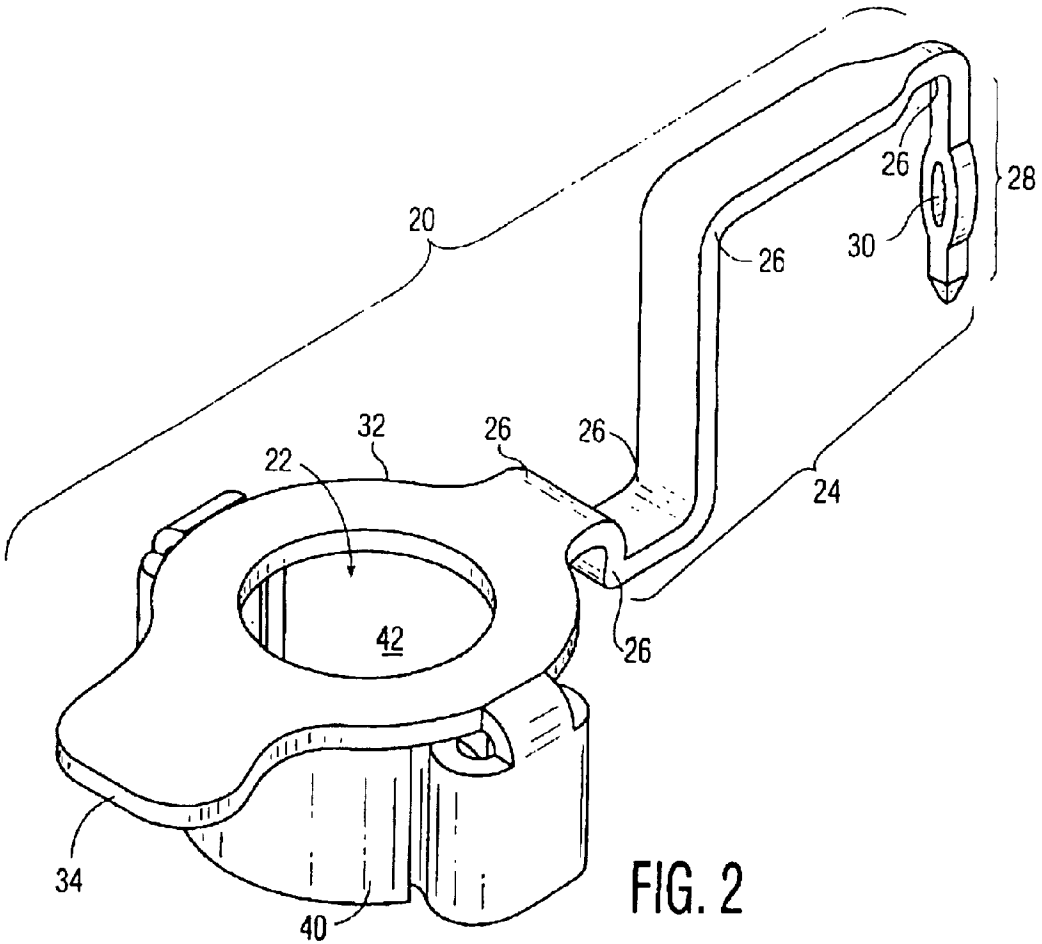
FIG. 2 is a top isomeric view of a ground lead support bushing assembly in accordance with an embodiment of the present invention illustrating the unitary structure of the ground lead and support bushing.

FIG. 2 shows a preferred embodiment of a grounding device in accordance with the present embodiment. The view is a top isometric view illustrating an embodiment of a ground lead 20 and support bushing 40, which are preferably blanked and formed from a single piece of material in this embodiment. The ground lead 20 and support bushing 40 do not require a bolt 50 to clamp the components together in this embodiment, since the ground lead 20 and support bushing 40 are blanked and formed from one piece of material. Ground lead 20 includes an arm 24 in this embodiment having a plurality of shoulders 26, which total five in this embodiment. The five shoulders 26 are preferably bent, such as at substantially 90-degree angles in this embodiment. Ground lead 20 also has a ring 32 and tail 34 protruding from the back of the ring 32. Tail 34 is slightly bent, on a downward plane in this embodiment, to provide balance to the ground lead 20 and support bushing 40. The arm 24 also comprises a needle 28 and an eye 30 in this embodiment, which provides for press fit contact into a circuit board. The ring 32 includes an aperture 22, which is substantially annular in the present embodiment. In addition, the support bushing 40 includes an aperture 42, which is also generally annular. Apertures 22 and 42 are preferably sized large enough in this embodiment, so as to allow the bolt 50 to pass there through and secure the ground lead 20 and support bushing 40, for example, to the exemplary grounding feature 60 in FIG. 1.

Figure 3:
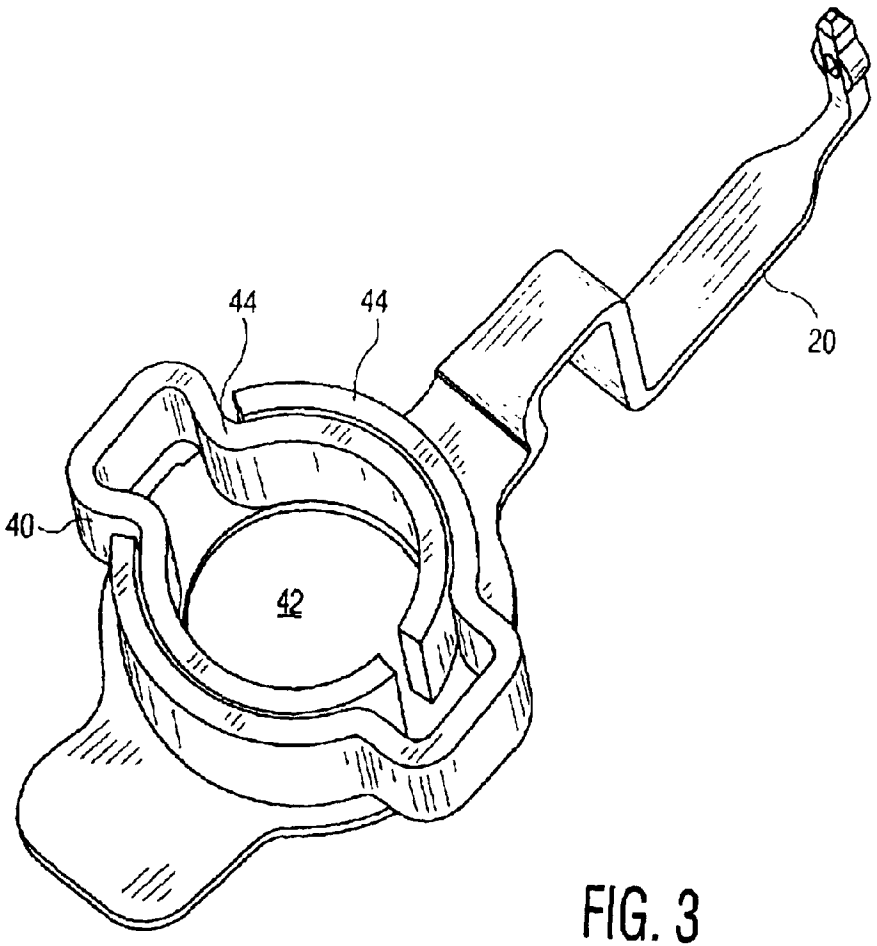
FIG. 3 is a bottom isometric view of a ground lead support bushing assembly in accordance with an embodiment of the present invention, illustrating the unitary structure of the ground lead and support bushing.

FIG. 3 illustrates a bottom isometric view of the support bushing of FIG. 2. The support bushing 40 in the present embodiment has two substantially circular overlapping elements 44, which create the aperture 42. In the present embodiment, aperture 42 is aligned with, and shares, a substantially similar circumference as aperture 22.

Figure 4:
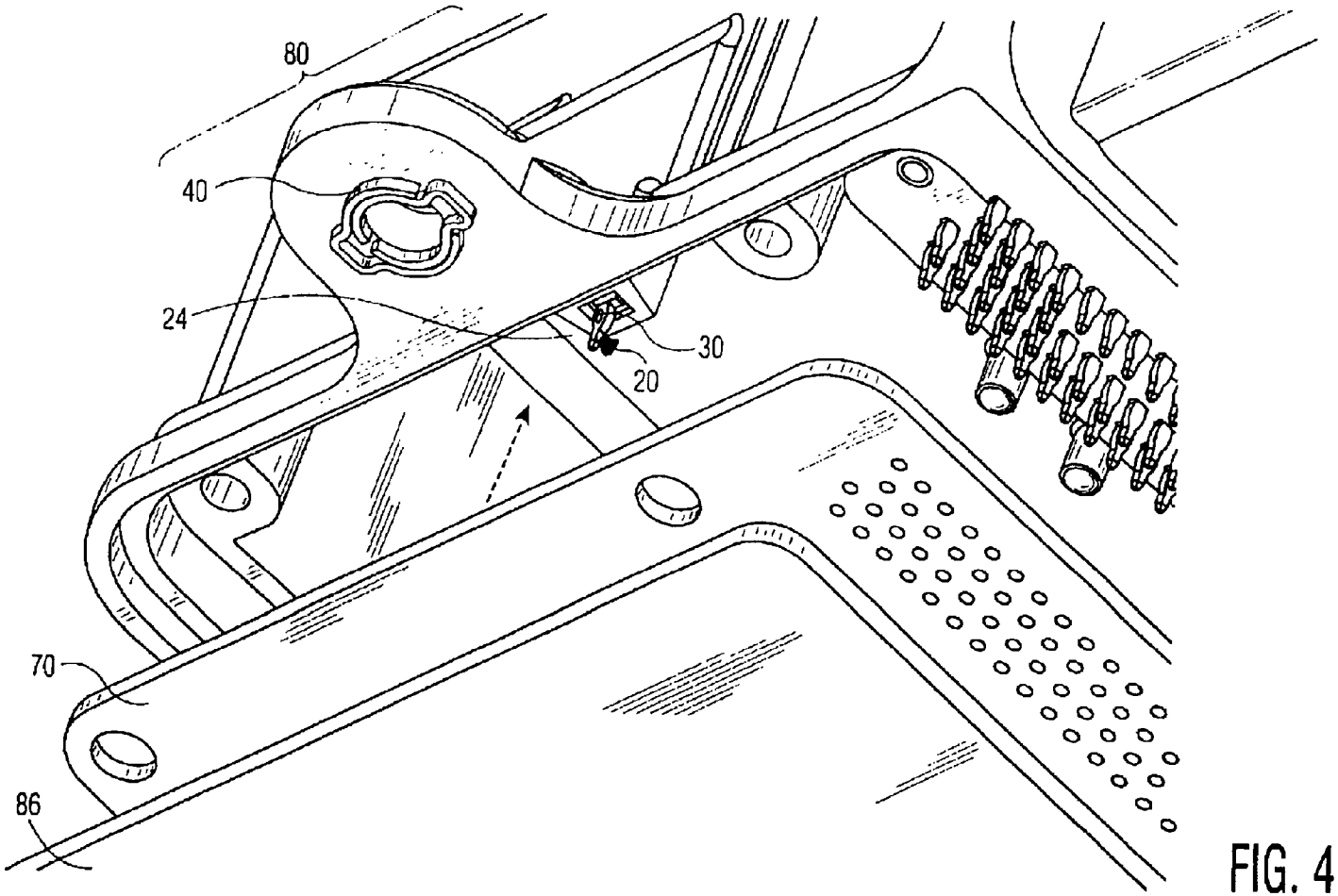
FIG. 4 is a perspective view of an embodiment of a ground lead contacted to an exemplary printed circuit board, which is contained in an exemplary housing.

FIG. 4 is a perspective view illustrating assembly of arm 24 into an exemplary housing 80 and connection to an exemplary printed circuit board 70 contained in housing 80. The aforementioned assembly is then enclosed when the cover to the housing 86 is put into place. As discussed above, the arm 24 in this embodiment preferably includes needle 28 having an eye 30, which provides for press fit contact to a printed circuit board 70.

Figure 5:
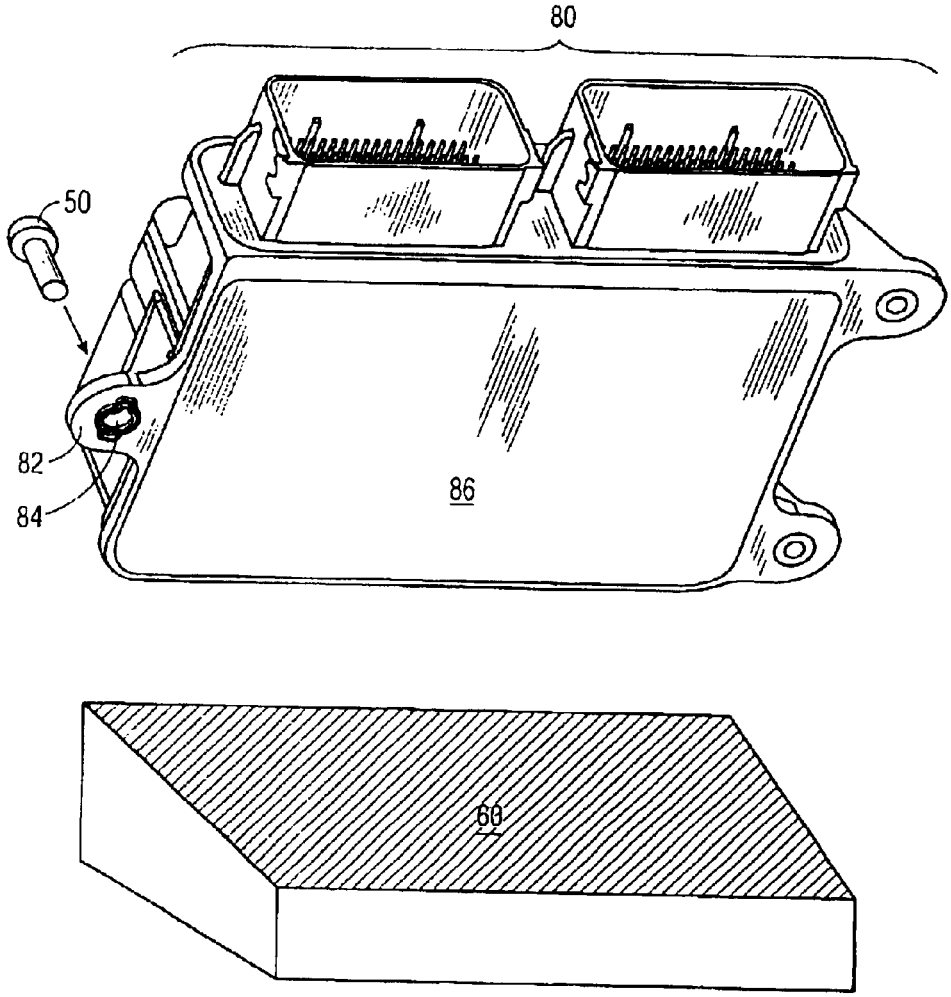
FIG. 5 is a perspective view illustrating a bolt passing through a mounting pad and into a grounding feature.

FIG. 5 illustrates a perspective view of the bolt 50 of FIG. 1, which passes through an aperture 84 of a mounting pad 82 after the cover to the housing 86 has been put in place. The bolt 50 then passes through apertures 22 and 42, respectively, and into a grounding feature 60.

Figure 6:
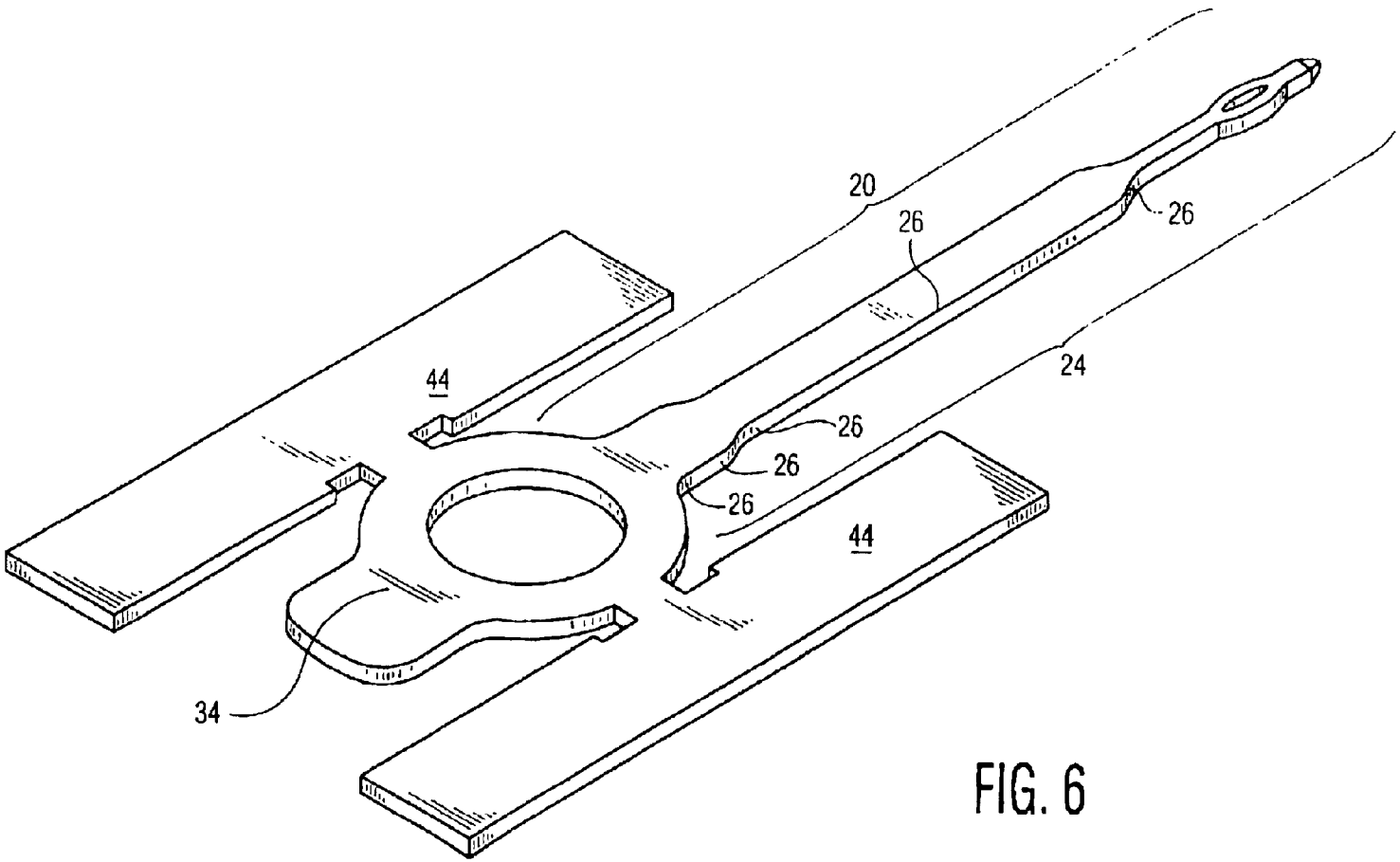
FIG. 6 is a perspective view of a flat pre-formed embodiment of the present invention, illustrating the unitary structure of the ground lead and support bushing.

FIG. 6 illustrates an exemplary embodiment of a substantially flat strip of a preferred embodiment of the present invention. In the forming process, ground lead 20 is formed when the five shoulders 26 of arm 24 of ground lead 20 are bent at substantially 90-degree angles, and when tail 34 is slightly bent in a downward direction. As the ground lead 20 is formed as described above, one or more, and preferably, two substantially rectangular members 44 are formed into the support bushing 40 of FIG. 2. The two substantially rectangular members 44 are formed underneath the ground lead 20 as substantially circular overlapping elements.

Figure 7:
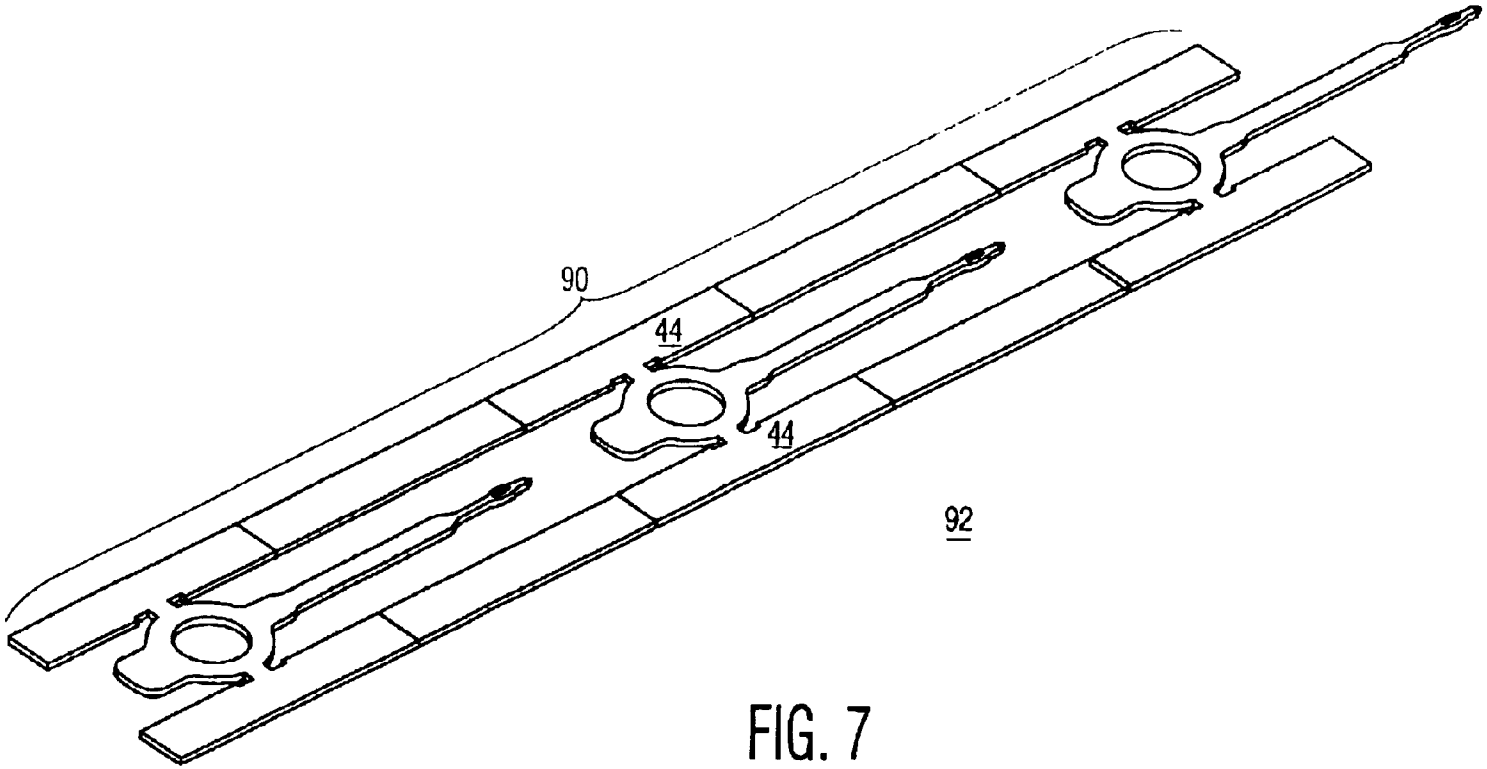
FIG. 7 is a perspective view of a plurality of the flat strip pre-formed embodiment of FIG. 6.

FIG. 7 illustrates, generally, a blanked carrier strip 90 of the flat ground lead 20 and two substantially rectangular members 44, which are formed into support bushing 40 of FIG. 2. In this embodiment, the carrier strip 90 has blank space 92, which is blanked to form individual flat strips of FIG. 6, which can then be formed into their desired configuration. In this embodiment, the carrier strip 90 and blank space 90 have been blanked from a piece of material.

Figure 8:
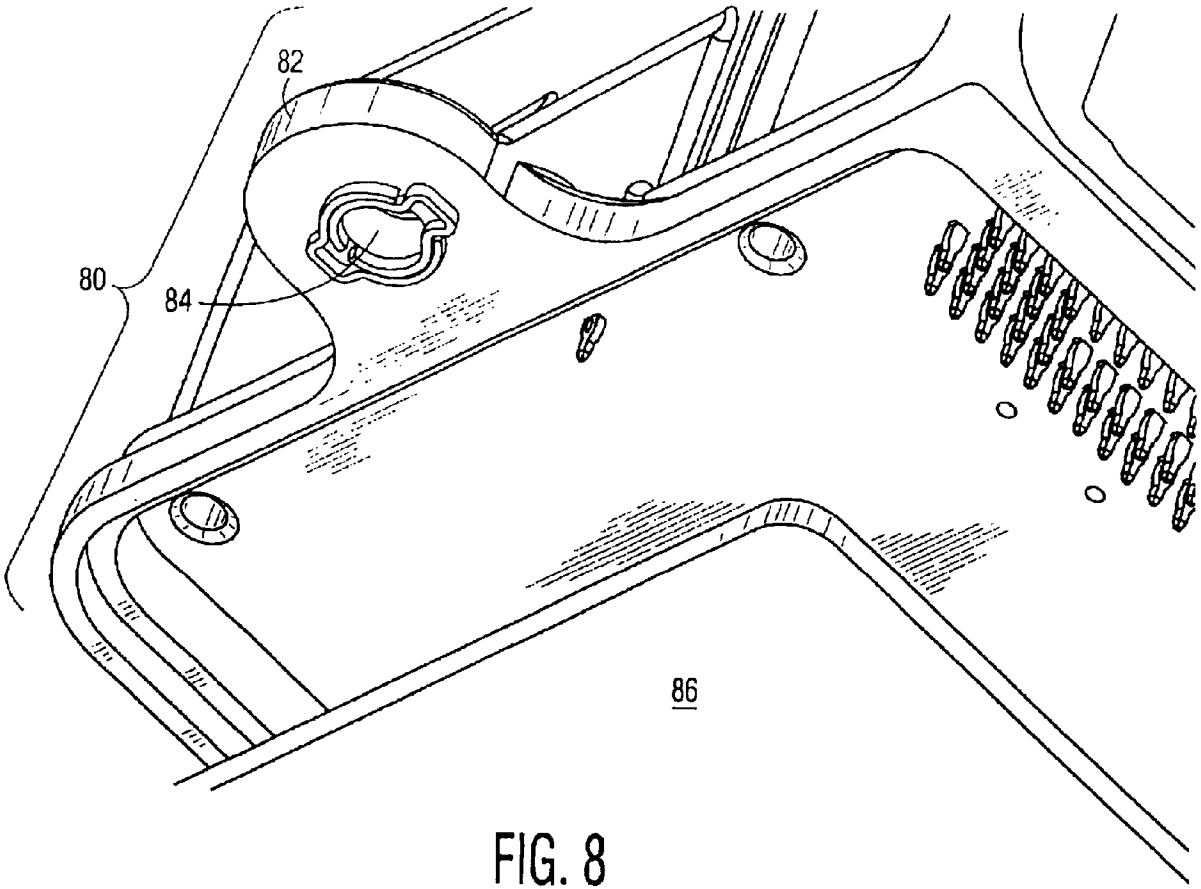
FIG. 8 is perspective view of a ground lead support bushing assembly contained within an exemplary housing.

FIG. 8 illustrates an exemplary housing 80 to be used with the apparatus and method of the present embodiment. The housing 80 in this embodiment is plastic and has a mounting pad 82 extending therefrom. The mounting pad 82 has an aperture 84, which allows the bolt 50 of FIG. 1 to pass through, to provide connection for the housing 80 to, for example, the grounding feature 60 of FIG. 1. The support bushing 40 and ring 32 and tail 34 of FIG. 2 are integrated into the mounting pad 82. The bolt then passes through aperture 84 of the mounting pad 82, through the aperture 22 of the ring 32, through the aperture 42 of the support bushing 40, and into the grounding feature 60 of FIG. 1.

For purposes of this invention, and without limitation, the grounding device and grounding feature described in the present embodiment is preferably comprised of stainless steel, aluminum, titanium, copper, or any other conductive material which exhibits appropriate grounding capacity. The housing in the aforementioned embodiments is comprised of a substantially non-conductive material, such as polyethylene, PBT, plastic or Teflon.

The above description and the views and material depicted by the figures are for the purpose of illustration only and are not intended to be, and should not be construed as, limitations on the invention.

Moreover, certain modifications or alterations may suggest themselves to those skilled in the art upon reading of this specification, all of which are intended to be within the spirit and scope of the present invention as defined in the attached claims.

What is claimed is:

1. A grounding device comprising:

a ground lead; and a support bushing, wherein the ground lead and the support bushing form a single integral and gaplessly continuous piece, with said grounding device having opposing substantially rectangular members that are positioned under a ring of said ground lead, wherein said substantially rectangular members are shaped into substantially overlapping generally circular members, wherein the grounding device is integrated into a plastic housing, and wherein a printed circuit board is contained within the plastic housing.

2. The grounding device of claim 1, wherein the ground lead and the support bushing are blocked and formed from one piece of material and said substantially rectangular members are substantially equivalent.

3. The grounding device of claim 1, wherein said substantially rectangular members are bent under a ring of said ground lead.

4. The grounding device of claim 1, wherein the material is electrically conductive.

5. The grounding device of claim 1, wherein the plastic housing has one or more mounting pads extending from the housing and said mounting pads having an aperture, whereby said mounting pads provide bolting means for connection of the plastic housing to the grounding feature.

6. The grounding device of claim 5, wherein the support bushing is integrated into the plastic housing at a point where a bolt will be inserted through the mounting pads and the grounding device.

7. The grounding device of claim 5, wherein the mounting pads are internally supported by said support bushing and wherein said support bushing allows a bolt to pass through an aperture in the support bushing.

8. The grounding device of claim 1, wherein the grounding lead is integrated into the printed circuit board.

* * * * *